US005762206A

United States Patent [19]

Leichter

[11] Patent Number: 5,762,206

[45] Date of Patent: Jun. 9, 1998

[54] CAP RACK

[76] Inventor: Henry S. Leichter, 5100 S. Convent La., Suite 406, Philadelphia, Pa. 19114

[21] Appl. No.: 866,404

[22] Filed: May 29, 1997

[51] Int. Cl.[6] ..... A47F 7/00

[52] U.S. Cl. ..... 211/32; 211/30; 211/87.01; 211/113

[58] Field of Search ..... 211/30, 32, 87.01, 211/85.1, 73, 113

[56] References Cited

U.S. PATENT DOCUMENTS

| | | | |
|---|---|---|---|
| 1,568,538 | 1/1926 | Argo . | |
| 3,333,708 | 8/1967 | LeBlanc et al. | 211/85.1 |
| 4,150,752 | 4/1979 | Breining et al. | 211/85.1 |
| 4,586,619 | 5/1986 | Eckert | 211/85.1 X |
| 5,002,190 | 3/1991 | Moreland . | |
| 5,038,941 | 8/1991 | Bastiaansen | 211/32 |
| 5,137,157 | 8/1992 | Lawson . | |
| 5,265,737 | 11/1993 | Freeby . | |
| 5,396,994 | 3/1995 | Fitzgerald . | |
| 5,411,144 | 5/1995 | Deupree . | |
| 5,450,967 | 9/1995 | Mallory . | |
| 5,505,316 | 4/1996 | Lee . | |
| 5,515,978 | 5/1996 | Moran | 211/30 |

*Primary Examiner*—Robert W. Gibson, Jr.
*Attorney, Agent, or Firm*—Ratner & Prestia

[57] ABSTRACT

A cap rack hangs a plurality of caps by their respective bands. The cap rack comprises a base and a plurality of substantially flat hook members which are each vertically arranged along the base and which extend horizontally only from that base. A portion of each hook member extends towards a further adjacent hook member and terminates with a hook member end to define a) an insertion opening between the hook member and the further hook member through which the cap band is inserted and b) a retaining opening adjacent to the insertion opening in which the cap band is hung. The retaining opening extends below the hook member end a greater distance than the hook member end is spaced apart from the adjacent hook member.

9 Claims, 5 Drawing Sheets

CAP RACK

FIELD OF THE INVENTION

The present invention relates to racks and in particular to racks for hanging and storing caps. Specifically, a cap rack is disclosed which may be used for hanging multiple caps and which allows one cap to be removed while retaining the other caps in their respective places.

BACKGROUND OF THE INVENTION

Collecting caps (e.g., baseball caps) has become a very popular hobby. The variety of caps which are sold today may appear to be limitless. When walking into any sport apparel store, one will observe that caps are sold displaying the colors and logos of hundreds of different sports teams.

A rear view of an exemplary cap is shown in FIG. 1. Cap 10 includes a main component 16 typically made of fabric. Main component 16 is typically semicircular in shape so that it may fit on the wearer's head. A button 12 is usually found on the top of cap 10 and is centered relative to main component 16. On the rear of cap 10, an adjustable band 20 is found. This band enables the cap to be customized relative to the size of the wearer's head. The band 20 is located across rear opening 14. Band 20 is actually comprised of two units, female unit 22 and male unit 24. Female unit 22 includes a plurality of projection receivers 28. Projection receivers 28 are desirably equally spaced relative to each other. Male unit 24 includes a plurality of projections 26, again equally spaced. Projection receivers 28 and projections 26 are spaced so that several projections 26 may be received in projection receivers 28. Projections 26 and projection receivers 28 are sized so that when projections 26 are inserted into projection receivers 28, the overlapping portions of female unit 22 and male unit 24 are held stationary relative to each other. Depending upon the amount of overlap between female unit 22 and male unit 24, the diameter of the cap can be modified accordingly. Thus, in this manner, the cap can be customized by the wearer for a most comfortable fit.

As some people collect caps, they desire to neatly store and display their collection. It may also be desirable to store and display the caps based upon a variety of criteria such as the use of a minimal amount of space, the ability to see all caps being displayed, the ease in removing any cap and the ease in storing and displaying that cap again at a later time. For this reason, many types of cap racks have become available.

U.S. Pat. No. 5,137,157 (Lawson) discloses a cap holder. As shown in FIG. 5 of Lawson, the cap band is held in place between prongs 12 and 13. As can also be seen from FIG. 5 of Lawson, each cap hangs down so that it overlaps the cap below. Thus, if the cap below is removed from the display, the cap above may be "knocked off" from the display. In fact, if one cap is removed, it is possible that there will be a domino effect and that many caps situated above will be "knocked off." When the user wishes to wear only one cap, it may be extremely inconvenient to have a plurality of caps knocked off a display with the need to subsequently reinsert these caps in the display.

U.S. Pat. No. 5,265,737 (Freeby) also discloses a cap rack. Again, the cap bands are each maintained in respective slots. As, again, each cap is vertically positioned relative to an adjacent cap, it is possible to "knock off" several caps while trying to remove one cap.

U.S. Pat. No. 5,396,994 (Fitzgerald) discloses a cap rack where the main component is folded and then the main component is inserted into a slot. By folding the cap, the cap may lose its original shape. In addition, as shown in FIG. 6 of Fitzgerald, each cap overlaps the cap below. Again, it is possible that one cap will be knocked off when another cap is removed.

In U.S. Pat. No. 5,411,144 (Deupree), the caps do not overlap. Because they do not overlap, however, the rack requires significantly more space than other designs in which overlap is permitted. In addition, folding of the main component of the cap is again required, which may possibly result in loss of original shape of the cap.

U.S. Pat. No. 5,450,967 (Mallory) discloses a large floor display for displaying caps. Because it is a large floor display, it may not be desirable for home use where space conservation may be required. As shown in FIG. 1 of Mallory, the caps do not overlap which again translates into a large amount of space consumption. As shown in FIGS. 6 and 7 of Mallory, the rack is assembled to form a triangle shape so that it may be self-supporting on a horizontal surface such as a floor.

U.S. Pat. No. 5,002,190 (Moreland) discloses a sports cap rack where, again, the caps do not overlap. A large amount of space is again required.

U.S. Pat. No. 1,568,538 (Argo) discloses a hat rack which extends perpendicularly from a wall. By storing the caps in this manner, it is difficult to see caps in the rear. Also, by projecting away from the wall, a large amount of horizontal space may be unnecessarily used.

Other types of racks are also known. For example, U.S. Pat. No. 5,505,316 (Lee) discloses an adjustable wrench-rack. Such racks are typically designed, however, for their intended purposes (i.e., storing wrenches) and, as such, may not be desirable for storing and displaying caps. As shown, each opening 42 is wider than the depth of the retaining slot 43 in which the wrench is retained. This allows easy removal of each wrench from the rack. Because each opening 42 is wider than the depth of each retaining slot 43, this rack may suffer from the drawbacks of some of the other racks which are specifically designed for caps, namely, when attempting to remove one cap, it is possible that other vertically adjacent caps may also be "knocked off."

SUMMARY OF THE INVENTION

A cap rack hangs a plurality of caps by their respective bands. The cap rack comprises a base and a plurality of substantially flat hook members which are each vertically arranged along the base and which extend horizontally only from that base. Each hook member also extends towards a further adjacent hook member and terminates with a hook member end to define a) an insertion opening between the hook member and the further hook member through which the cap band is inserted and b) a retaining opening adjacent to the insertion opening in which the cap band is hung. The retaining opening extends below the hook member end a greater distance than the hook member end is spaced apart from the adjacent hook member.

BRIEF DESCRIPTION OF THE FIGURES

In FIG. 4, a cap is shown hanging from the cap rack.

DETAILED DESCRIPTION OF THE INVENTION

Figure 1:
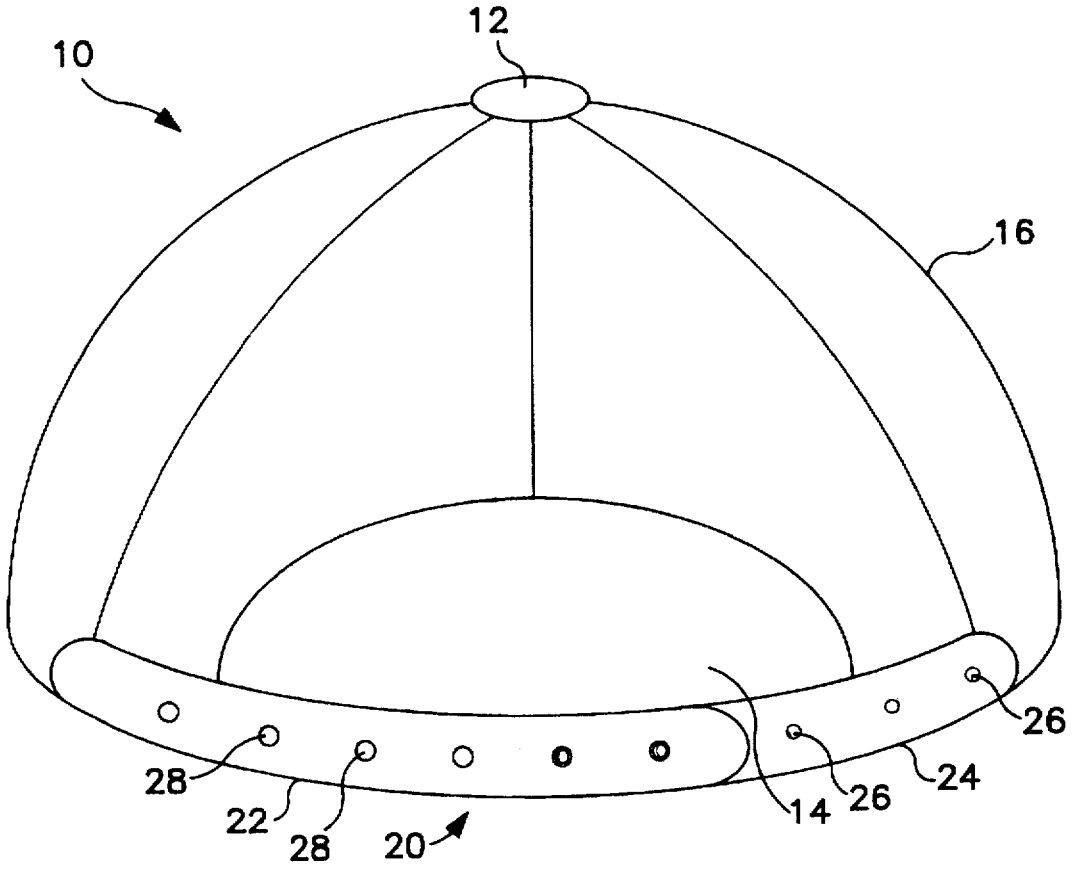
FIG. 1 PRIOR ART
FIG. 1 a rear view of a cap in accordance with the prior art.
Figure 2A:
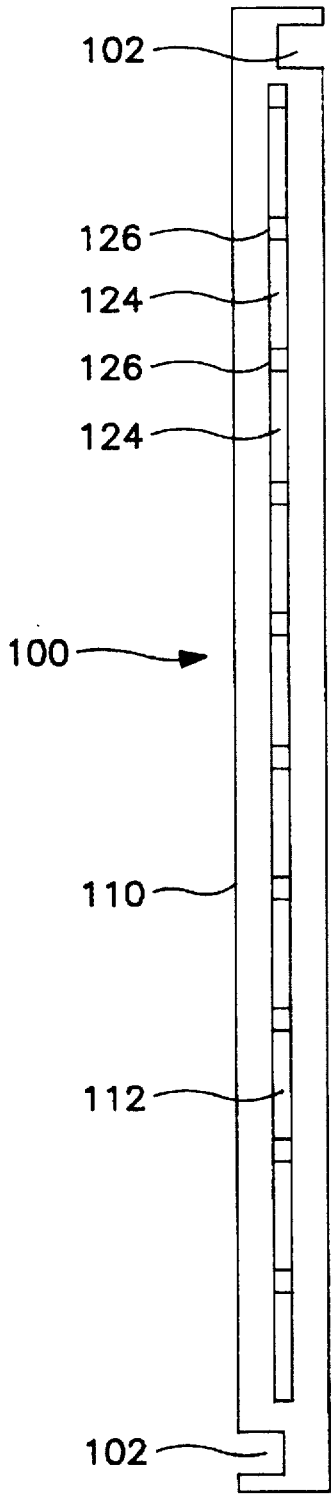
FIG. 2*a* is a front view and FIG. 2*b* is a side view of a cap rack in accordance with a first exemplary embodiment of the present invention.
Figure 2B:
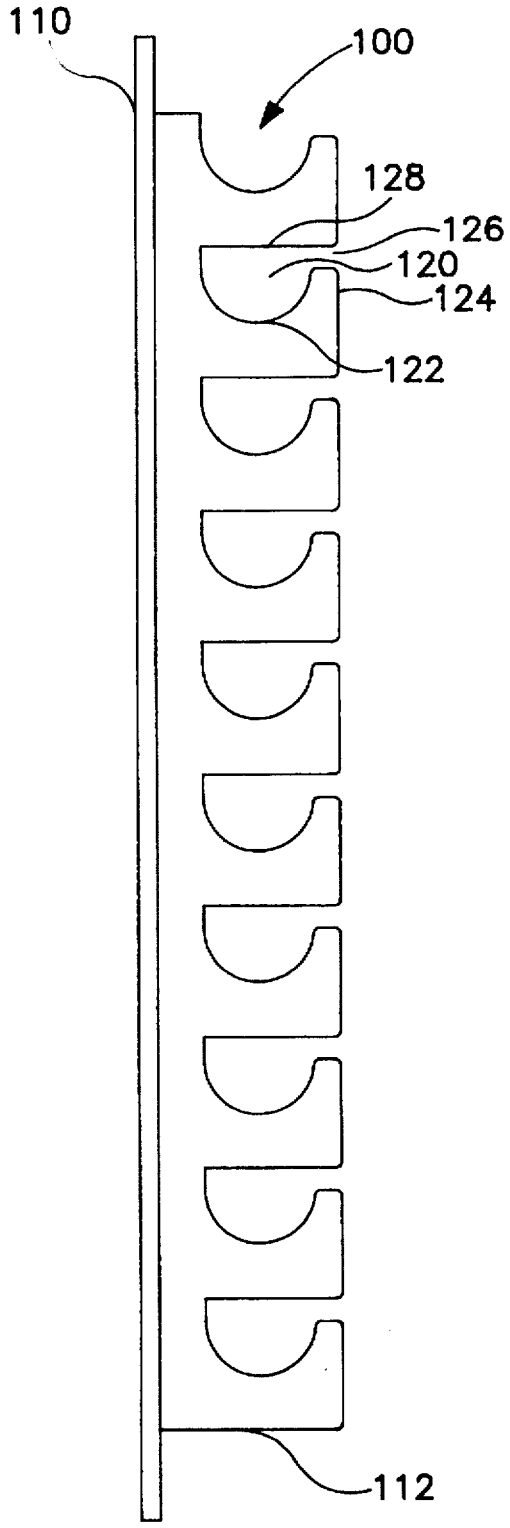

FIGS. 2*a* and 2*b* are a respective front view and side view of cap rack 100 in accordance with a first exemplary embodiment of the present invention.

Cap rack 100 includes a base 110 and plurality of substantially flat cap hook members 112 which each extend horizontally only from the base.

As shown, each cap hook member 112 includes a retaining opening 120 in which the cap band resides while the cap is hanging on cap rack 100. Retaining opening 120 is defined by retainer bottom 122 which is desirably formed in a semicircular shape. Each cap hook member 112 terminates in a hook member end 124. Hook member end 124 is spaced below an adjacent cap hook member 112. By spacing hook member end 124 below an adjacent cap hook member 112, insertion opening 126 is defined. The bottom of the adjacent cap hook member 112 defines retainer top 128.

Thus, retaining opening 120 is defined by retainer top 128 and retainer bottom 122 which terminates with hook member end 124.

As shown in FIG. 2*a*, anchoring opening 102 is formed in base 110 so that cap rack 100 may be affixed to a vertical surface such as a wall. Alternatively, a hanging mechanism may be attached to anchoring opening 102 so that the cap rack may be hung, like a clothes hanger, on a horizontally situated clothes hanging pole. FIG. 2*a* shows two separate anchoring openings 102. The bottom anchoring opening may be deleted if desired.

Figure 3:
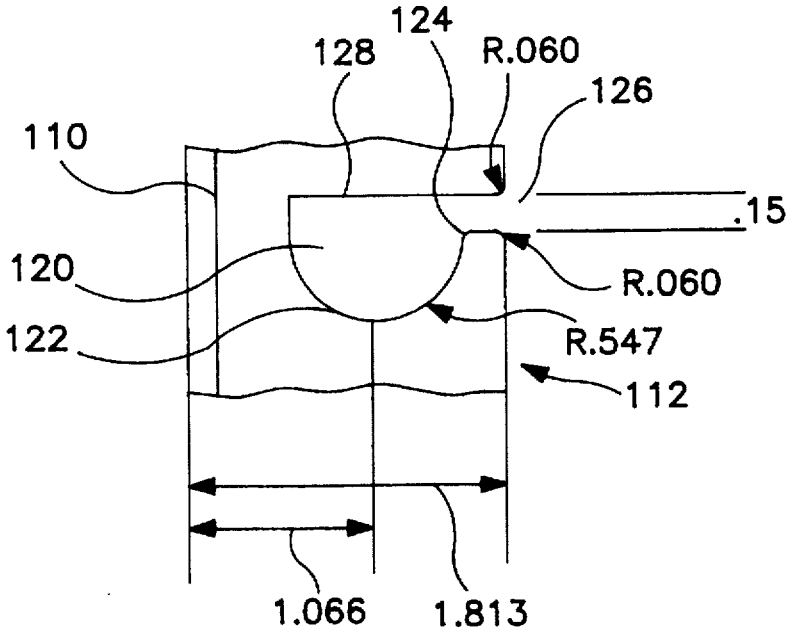
FIG. 3 is a magnified view of the cap rack shown in FIGS. 2*a* and 2*b*.

In FIG. 3, exemplary measurements are disclosed. These measurements are provided strictly for explanatory purposes. It is understood that one of ordinary in the art could manufacture the present cap rack to have many different dimensions. As shown, the horizontal width of the cap rack may be 1.813 inches. The center of retaining opening 120 may be located 1.066 inches from the base. The radius of retaining opening 120 may be 0.547 inches. Hook member end 124 may be rounded off to have a radius of 0.060 inches. Insertion opening 126 may have a distance of 0.15 inches.

As illustrated by FIGS. 2*b* and 3, the distance from the top 125 of hook member end 124 to the bottom 122 of retaining opening 120 is always larger than the distance from the top 125 of hook member end 124 to retainer top 128 directly above. Thus, when storing a cap in cap rack 110, band 20 is first inserted through insertion opening 126 so that band 20 comes to rest inside retaining opening 120. In this manner, a locking effect is obtained by hook member end 124. To remove cap 10 from cap rack 100, it is necessary to bring band 20 away from base 110 and through insertion opening 126.

By forming the retaining opening 120 so that the distance from the top 125 of hook member end 124 to the bottom 122 of retaining opening 120 is larger than the distance of insertion opening 126, other caps are likely to stay in place when one cap is removed. This is particularly advantageous because it allows one cap to be removed from cap rack 100 without "knocking off" adjacent caps from cap rack 100.

Cap rack 100 is desirably made from injection molded plastic. One of ordinary skill in the art readily recognizes that other materials and methods of manufacturing may be used.

As shown in the Figures, each cap hook member 112 extends perpendicularly from base 110. It is possible, however, that hook member 112 will extend from base 110 at other angles besides the perpendicular angle shown in the figures. Also, as shown in the figures, each cap hook member is desirably thin and flat with opposite faces (i.e., the faces extending from base 110) being substantially parallel to each other.

Figure 4:
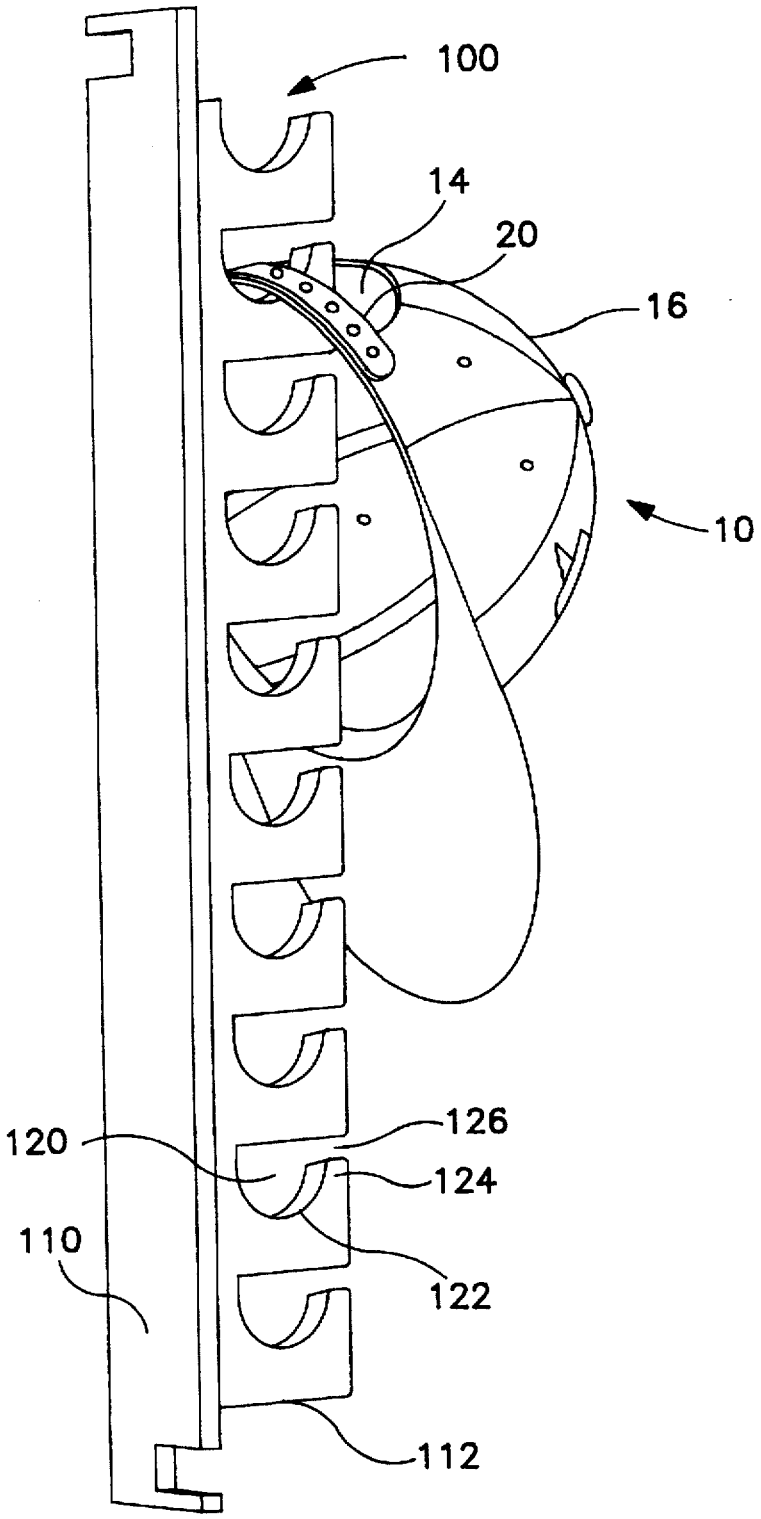
FIG. 4 is a perspective view of the cap rack shown in FIGS. 2*a*, 2*b* and 3.

FIG. 4 is a perspective view of cap rack 100 with cap 10 shown hanging from cap rack 100. As shown, band 20 has been inserted through insertion opening 126 so that it resides within retaining opening 120. As can be implied from FIG. 4, one cap 10 may partially overlap another cap 10 situated below.

Figure 5:
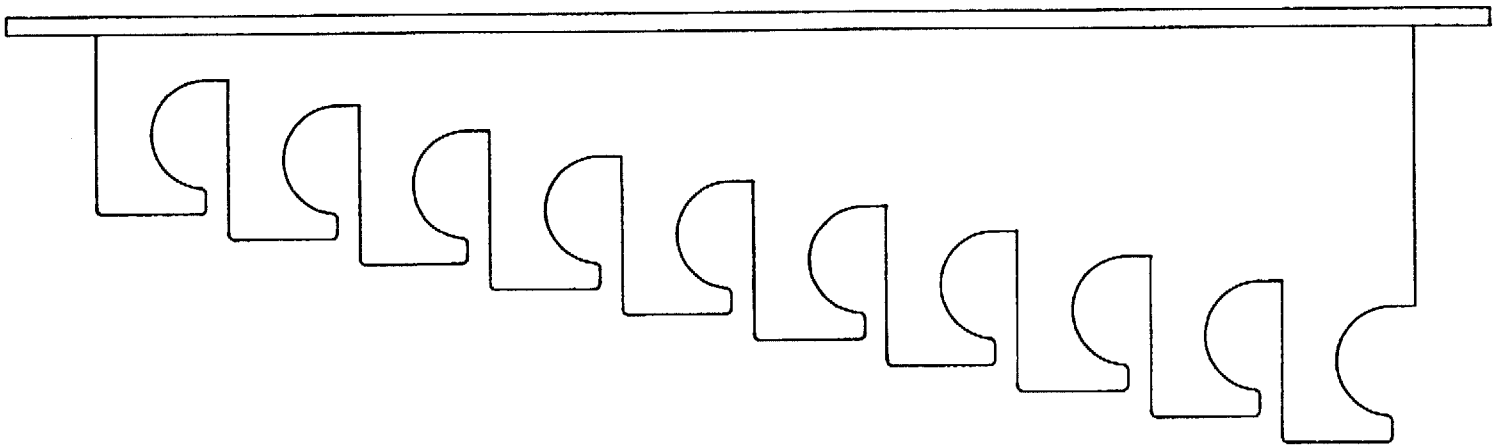
FIG. 5 is a side view of a cap rack in accordance with a further exemplary embodiment of the present invention.

FIG. 5 is a side view of an alternative embodiment of the present invention. As shown in FIG. 5, each hook member 112 extends from base 110 a greater distance than the distance by which an adjacent hook member 112 situated below also extends.

While preferred embodiments of the invention have been shown and described herein, it will be understood that such embodiments are provided by way of example only. Numerous variations, changes, and modifications will occur to those skilled in the art without departing from the spirit of the invention. Accordingly, it is intended that the appended claims cover all such variations as fall within the spirit and scope of the invention.

What is claimed is:

1. A cap rack for hanging a plurality of caps by their respective bands, comprising:

a base;

a plurality of substanially flat hook members, each vertically arranged along said base and extending horizontally only therefrom, a hook member end of each of said hook members extending upwards towards a further hook member of said plurality of hook members adjacent thereto and terminating with a top to define:

a) an insertion opening between said hook member end and said further hook member through which a respective one of said bands is inserted; and b) a retaining opening adjacent to said insertion opening and extending below said top of said hook member end a greater distance than said top of said hook member end is vertically spaced apart from said further hook member and in which said respective one of said bands of said respective caps is hung.

2. A cap rack according to claim 1, wherein said base includes an opening for attaching said cap rack to a surface.

3. A cap rack for hanging a plurality of caps by their respective bands, comprising:

a base; and a plurality of substantially flat hook members arranged vertically along said base, each of said hook members extending horizontally only away from said base, a portion thereof extending upwards and spaced apart from a respective adjacent one of said hook members above thereto to define a) an insertion opening through which a respective one of said bands is inserted; and b) a retaining opening adjacent said insertion opening in which respective one of said bands resides and which extends a greater distance from a bottom thereof to a bottom of said insertion opening than said insertion opening extends between said hook member and said adjacent one of said hook members.

4. A cap rack according to claim 3, wherein said base includes an opening for attaching said cap rack to a surface.

5. A cap rack display, comprising:

a plurality of caps each having a band;

a base;

a plurality of substantially flat hook members, each vertically arranged along said base and extending orthogonally only therefrom, a hook member end of each of said hook members extending upwards towards a further hook member of said plurality of hook members adjacent thereto and terminating with a top to define:

a) an insertion opening through which said band is inserted, and b) a retaining opening adjacent to said insertion opening and extending below said hook member end a greater distance than said hook member end is vertically spaced apart from said further hook member and in which said band of respective ones of said caps is respectively hung.

6. A cap rack according to claim 5, wherein said base includes an opening for attaching said cap rack to a surface.

7. A cap rack display, comprising:

a plurality of caps each having respective bands;

a base; and a plurality of substantially flat hook members arranged vertically along said base, each of ones of said hook members extending only away from said base, a portion thereof extending upwards and spaced apart from a respective adjacent one of said hook members above thereto to define a) an insertion opening through which one of said bands is inserted; and b) a retaining opening adjacent said insertion opening in which said one of said bands resides and which extends a greater distance from a bottom thereof to a bottom of said insertion opening than said insertion opening extends between said hook member and said respective adjacent one of said hook members.

8. A cap rack according to claim 7, wherein said base includes an opening for attaching said cap rack to a surface.

9. A method of displaying a plurality of caps, each cap of said plurality of caps including a respective band, said method comprising the steps of:

a) forming a plurality of insertion openings along an edge of a substantially flat member;

b) forming a plurality of retainer openings, each adjacent to a respective one of said insertion openings, each of said plurality of retainer openings extending below said respective one of said insertion openings a greater distance than said respective one of said insertion openings vertically extends;

c) sliding each respective band of each of said caps into a respective one of said insertion openings; and d) enabling each respective band of each of said caps to move downward into said retainer opening so that each respective band is completely below said insertion opening and each respective said band is in said retainer opening.

* * * * *

UNITED STATES PATENT AND TRADEMARK OFFICE

CERTIFICATE OF CORRECTION

PATENT NO. : 5,762,206
DATED : June 9, 1998
INVENTOR(S) : Leichter

It is certified that error appears in the above-identified patent and that said Letters Patent is hereby corrected as shown below:

On the Cover Page, Field [56] References Cited, Other Publications, please add -- Carol Wright Gifts, Lincoln, NE 68544-8503, 1997. --

Signed and Sealed this

Sixth Day of October, 1998

*Attest:*

Bruce Lehman

BRUCE LEHMAN

*Attesting Officer*

*Commissioner of Patents and Trademarks*